US005931553A

United States Patent [19]

Cohen

[11] Patent Number: 5,931,553

[45] Date of Patent: Aug. 3, 1999

[54] CABINET

[75] Inventor: Roni Cohen, Atarot, Israel

[73] Assignee: Zag Industries Ltd., Rosh Ha'Ayin, Israel

[21] Appl. No.: 09/004,497

[22] Filed: Jan. 8, 1998

[51] Int. Cl.[6] ..... A47B 47/00

[52] U.S. Cl. ..... 312/263; 312/257.1; 312/108; 312/351.3

[58] Field of Search ..... 312/400, 263, 312/257.1, 108, 111, 265.5, 329, 351, 326, 351.3, 351.1, 206

[56] References Cited

U.S. PATENT DOCUMENTS

| | | | |
|---|---|---|---|
| 3,104,140 | 9/1963 | Radi | 312/351.3 X |
| 3,159,438 | 12/1964 | Carlson et al. | 312/351.3 X |
| 3,779,623 | 12/1973 | Motohashi | 312/108 X |
| 4,322,118 | 3/1982 | Shugart | 312/111 |
| 4,691,644 | 9/1987 | Frydman | 312/265.5 X |
| 4,728,158 | 3/1988 | D'Elia et al. | 312/263 X |
| 5,048,902 | 9/1991 | Daly | 312/257.1 X |
| 5,368,380 | 11/1994 | Mottmiller et al. | 312/111 X |
| 5,372,415 | 12/1994 | Tisbo et al. | 312/108 |
| 5,466,058 | 11/1995 | Chan | 312/107 X |
| 5,642,923 | 7/1997 | Meacham et al. | 312/263 X |

*Primary Examiner*—Peter M. Cuomo
*Assistant Examiner*—James O. Hansen
*Attorney, Agent, or Firm*—Pillsbury Madison & Sutro LLP

[57] ABSTRACT

An injected plastic cabinet comprising a top, a bottom, a back wall, and left and right side walls being connected together, forming a box having a front opening, and at least one door element being hingedly connected to at least one of the left and right side walls for covering the front opening, wherein each of the back wall, left and right side walls and each of the door elements is at least 160 centimeters in height and is a product of a single plastic injection.

8 Claims, 19 Drawing Sheets

CABINET

FIELD AND BACKGROUND OF THE INVENTION

The present invention relates to a cabinet and, more particularly, to a cabinet made of injected plastic components.

A cabinet is a boxed piece of furniture having front doors and internal partitions, dividers, shelves and drawers which, depending on the application, is used for storage of various items from clothing to working tools, etc. Traditionally cabinets were made of wood. However, in recent years cabinets made of plastic were also introduced into the market.

In the first generation of plastic cabinets, designers implemented the basic working methods of carpentering by connecting together via screws, nuts, pins and/or glue and the like molded plastic plates as if those were wood plates.

However, since plastic is much more elastic, workable and less tough than wood, the first generation plastic cabinets suffered from instability and weakness. Furthermore, they could not be sold disassembled since the process of their assembly required skilled personnel.

In the second generation plastic cabinets, injected plastic plates, strengthened by longitudinal internal cells formed during the process of injection, are employed. However, the plates employed are of maximal height of about one meter or less and therefore, the number of parts required to construct the basic longitudinal features of the cabinet, i.e., back, sides and door(s) is doubled.

There is thus a widely recognized need for, and it would be highly advantageous to have, an injected plastic cabinet devoid of the above limitation, and which enjoy other advantages, as further detailed hereinunder.

SUMMARY OF THE INVENTION

According to the present invention there is provided an injected plastic cabinet.

According to further features in preferred embodiments of the invention described below, the injected plastic cabinet comprising a top, a bottom, a back wall, and left and right side walls being connected together, forming a box having a front opening, and at least one door element being hingedly connected to at least one of the left and right side walls for covering the front opening, wherein each of the back wall, left and right side walls and each of the door elements is at least 160 centimeters in height and is a product of a single plastic injection.

According to further features in preferred embodiments of the invention described below, the injected plastic cabinet comprising a top, a bottom, a back wall, and left and right side walls being connected together, forming a box having a front opening, and at least one door element being hingedly connected to at least one of the left and right side walls via metal hinges for covering the front opening, wherein each of the back wall, left and right side walls and each of the door elements is a product of a single plastic injection.

According to further features in preferred embodiments of the invention described below, the injected plastic cabinet comprising a top, a bottom, a back wall, and left and right side walls being connected together, forming a box having a front opening, at least one door element being hingedly connected to at least one of the left and right side walls for covering the front opening, wherein each of the back wall, left and right side walls and each of the door elements is a product of a single plastic injection and being formed with longitudinal strengthening internal cells, the injected plastic cabinet further including at least one shelf being connected to the internal cells of the side walls, thereby contributing strength and stability to the cabinet.

According to further features in preferred embodiments of the invention described below, the injected plastic cabinet comprising a top, a bottom, a back wall, and left and night side walls being connected together, forming a box having a front opening, and at least one door element being hingedly connected to at least one of the left and right side walls for covering the front opening, wherein each of the back wall, left and right side walls and each of the door elements is a product of a single plastic injection and being formed with longitudinal strengthening internal cells, the injected plastic cabinet further including at least two adapters being inserted through openings formed in the top into the longitudinal strengthening internal cells of the left and right side walls, thereby contributing strength and stability to the cabinet.

According to further features in preferred embodiments of the invention each of the door elements is hingedly connected to one of the left or right side walls via metal hinges.

According to further features in preferred embodiments of the invention the injected plastic cabinet further comprising leveling legs being accepted by the bottom.

According to further features in preferred embodiments of the invention the number of leveling legs is selected from the group consisting of four and five.

According to further features in preferred embodiments of the invention the back wall and the left and right side walls are connected therebetween via adjustment pins and snap-on mechanisms.

According to further features in preferred embodiments of the invention the injected plastic cabinet further comprising a longitudinal divider dividing the box into left and right sections.

According to further features in preferred embodiments of the invention the divider is a partial divider.

According to further features in preferred embodiments of the invention the door elements include a left door element hingedly connected to the left side wall and a right door element hingedly connected to the right side wall.

According to further features in preferred embodiments of the invention at least one of the metal hinges is connected via a screw to at least one of the adapters, thereby locking together the top, at least one of the adapters and at least one of the left and right side walls.

The present invention successfully addresses the shortcomings of the presently known configurations by providing an injected plastic cabinet which includes a minimal number of parts, is easy to assemble, and due to its special design and features, enjoys extra stability, strength and balance.

These and other features of the injected plastic cabinet of the present invention are described hereinunder.

BRIEF DESCRIPTION OF THE DRAWINGS

The invention herein described, by way of example only, with reference to the accompanying drawings, wherein.

Please note that different or same parts are drawn to different scales.

DESCRIPTION OF THE PREFERRED EMBODIMENTS

Figure 1:
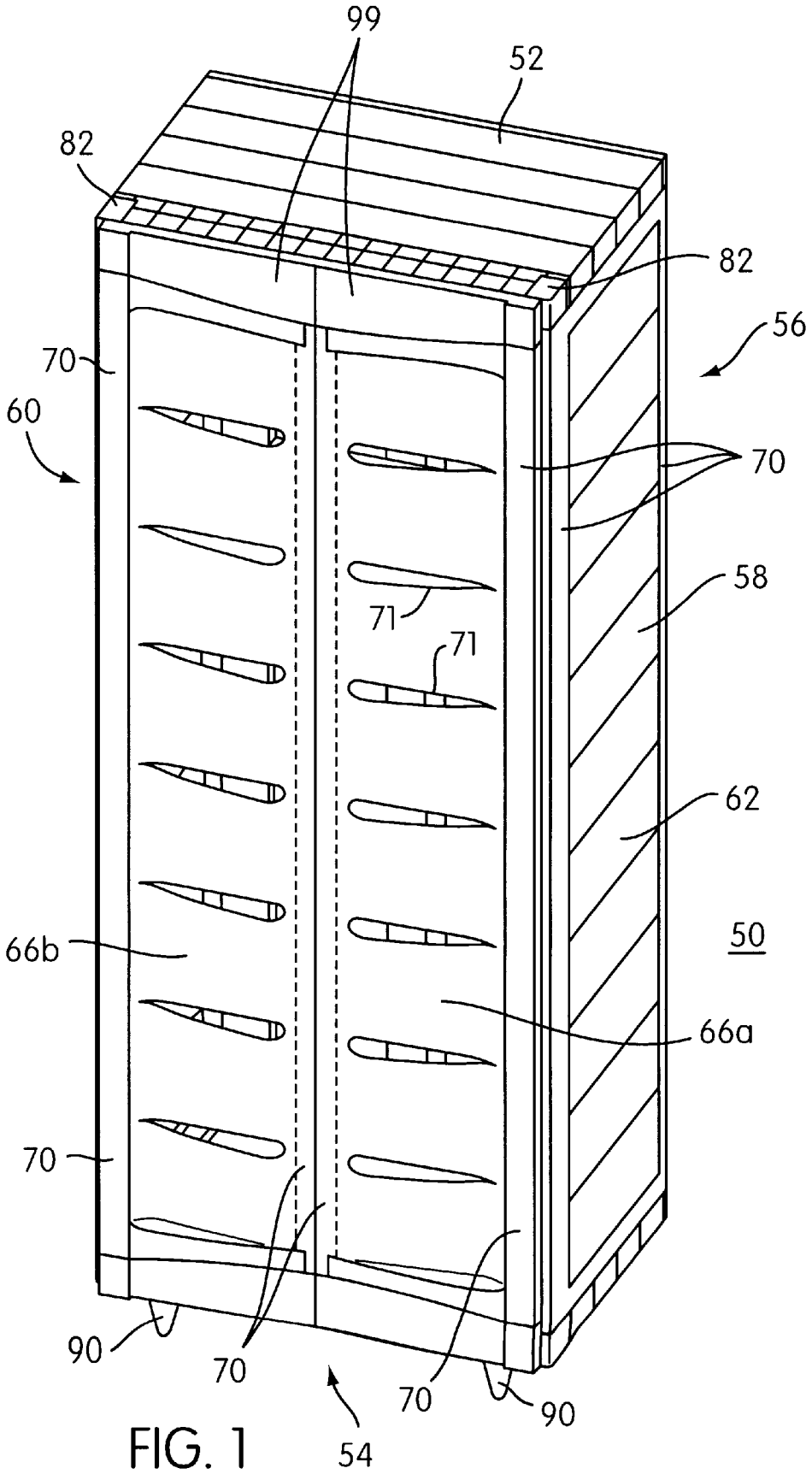
FIG. 1 is a perspective front view of the injected plastic cabinet according to the present invention.
Figure 2:
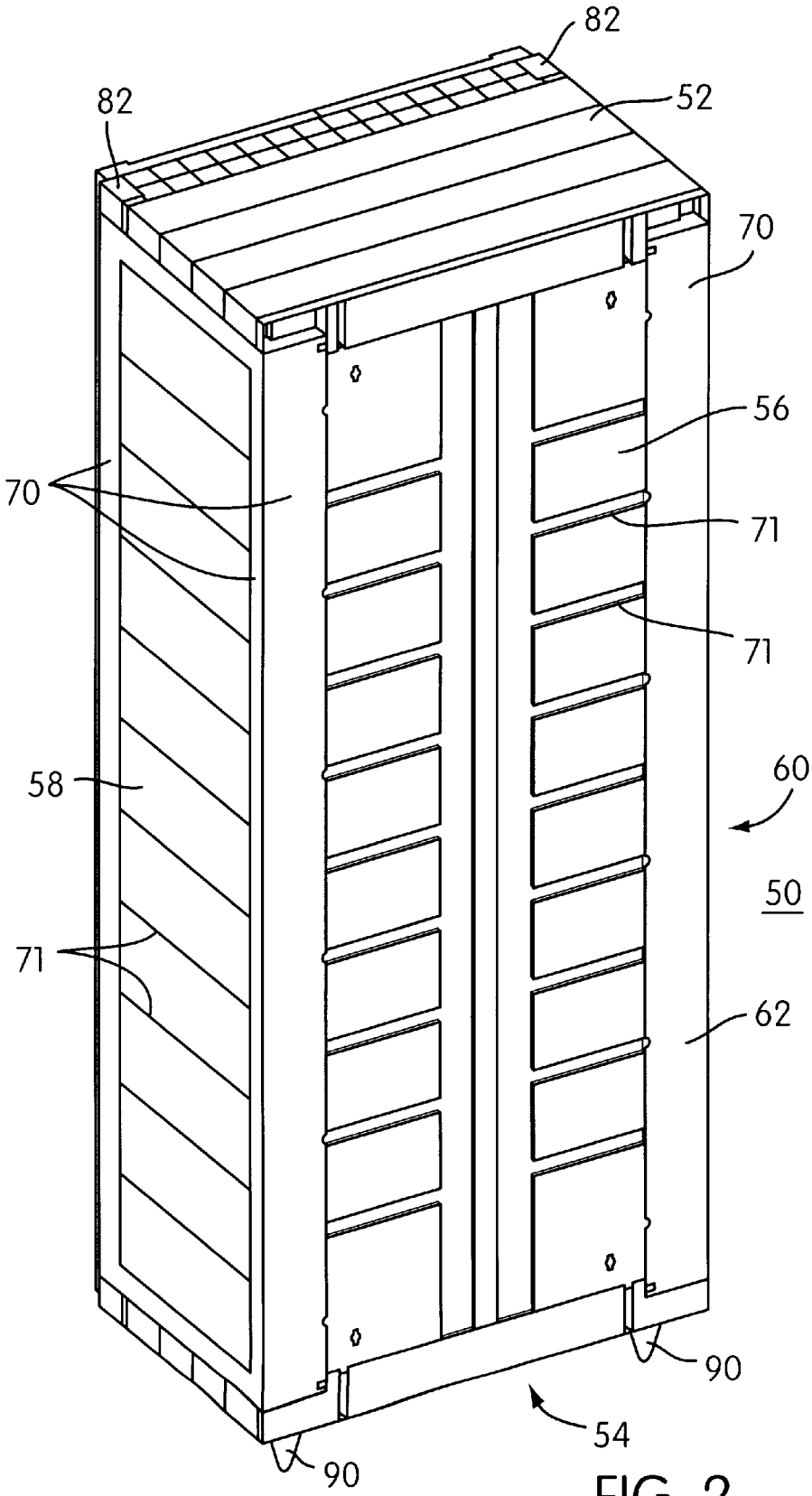
FIG. 2 is a perspective rear view of the injected plastic cabinet according to the present invention.

The present invention is of an injected plastic cabinet which can be used for storage of various items, such as, but not limited to, clothing, food products, tools (working, garden and/or household tools) and the like. Specifically, the present invention can be used to provide a plastic cabinet which is easy to assemble, since it includes a minimal number of parts and is highly strong and stable due to its unique features as herein described.

The principles and operation of an injected plastic cabinet according to the present invention may be better understood with reference to the drawings and accompanying descriptions.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

Figure 5:
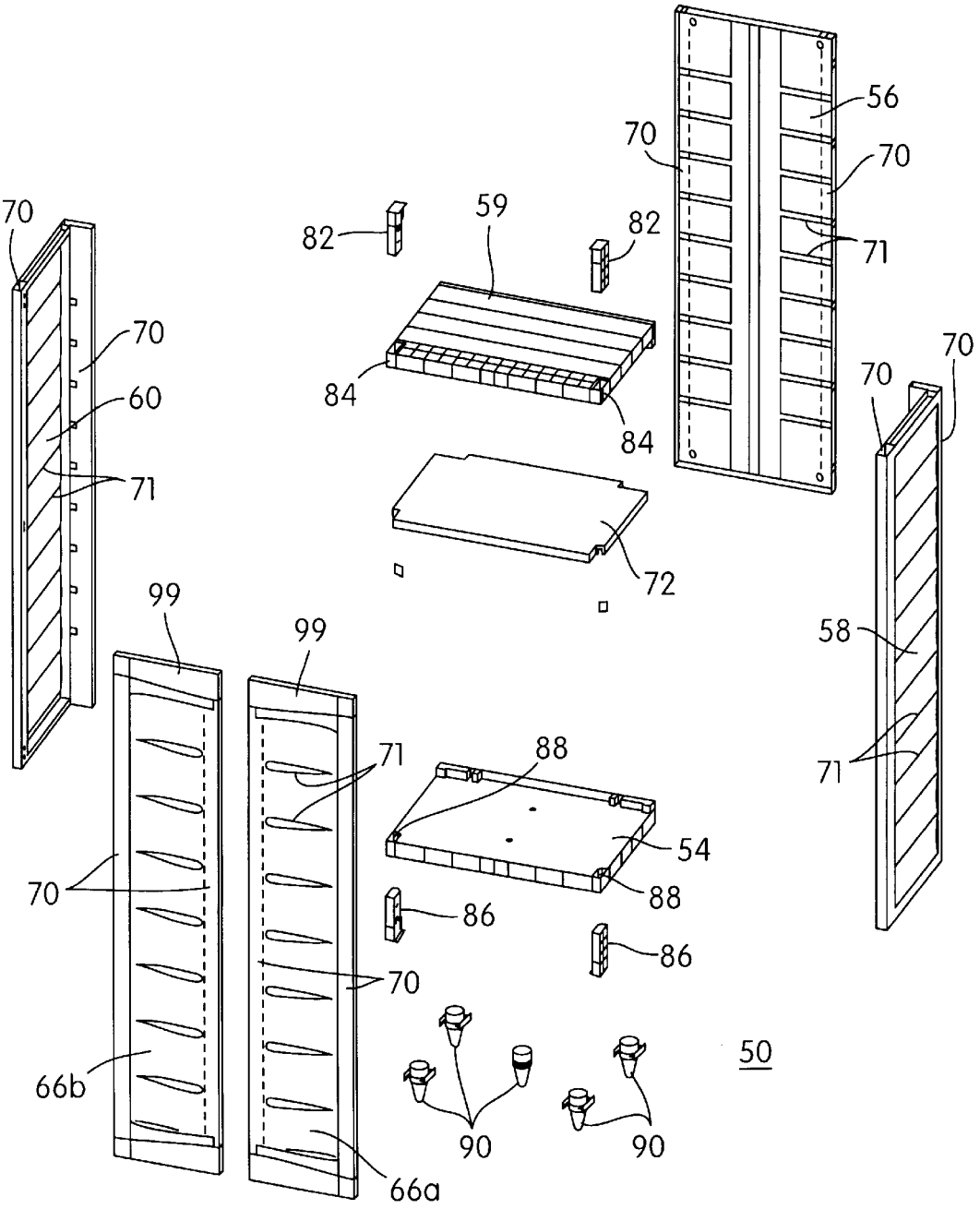
FIG. 5 is an exploded view of some of the main components of the injected plastic cabinet according to the present invention.

Referring now to the drawings, FIGS. 1–4 provide perceptive views of some basic parts of the injected plastic cabinet according to the present invention, which is referred to hereinbelow as cabinet 50, whereas FIG. 5 provides an exploded view of same.

Thus, injected plastic cabinet 50 includes a top 52, a bottom 54, a back wall 56, and left 58 and right 60 side walls. These components are connected together, to form a box 62 having a front opening 64, best seen in FIG. 3.

Figure 11:
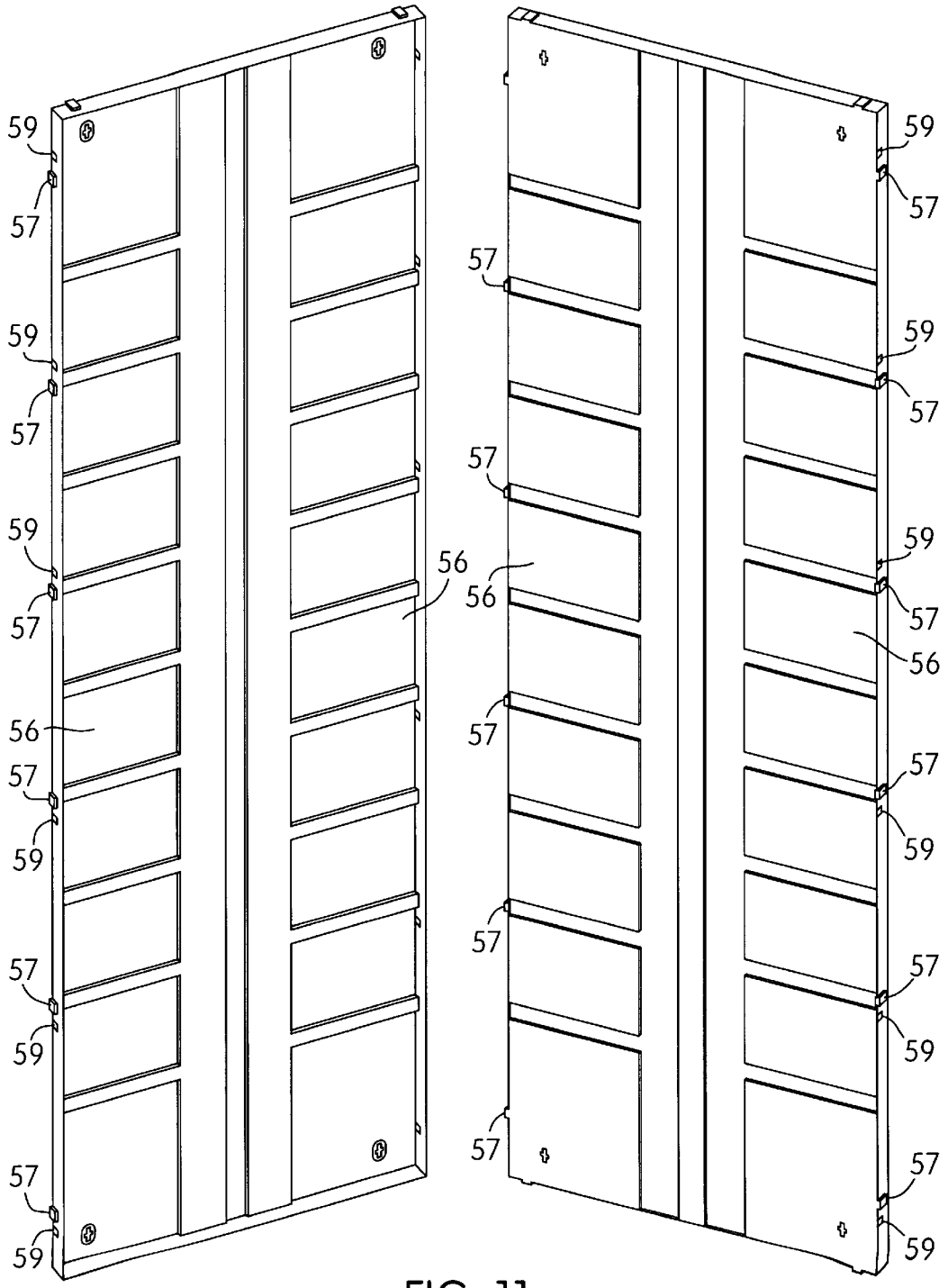
FIG. 11 is a perspective view of a back wall of the of the injected plastic cabinet according to the present invention (inner side—left, outer side—right)
Figure 12:
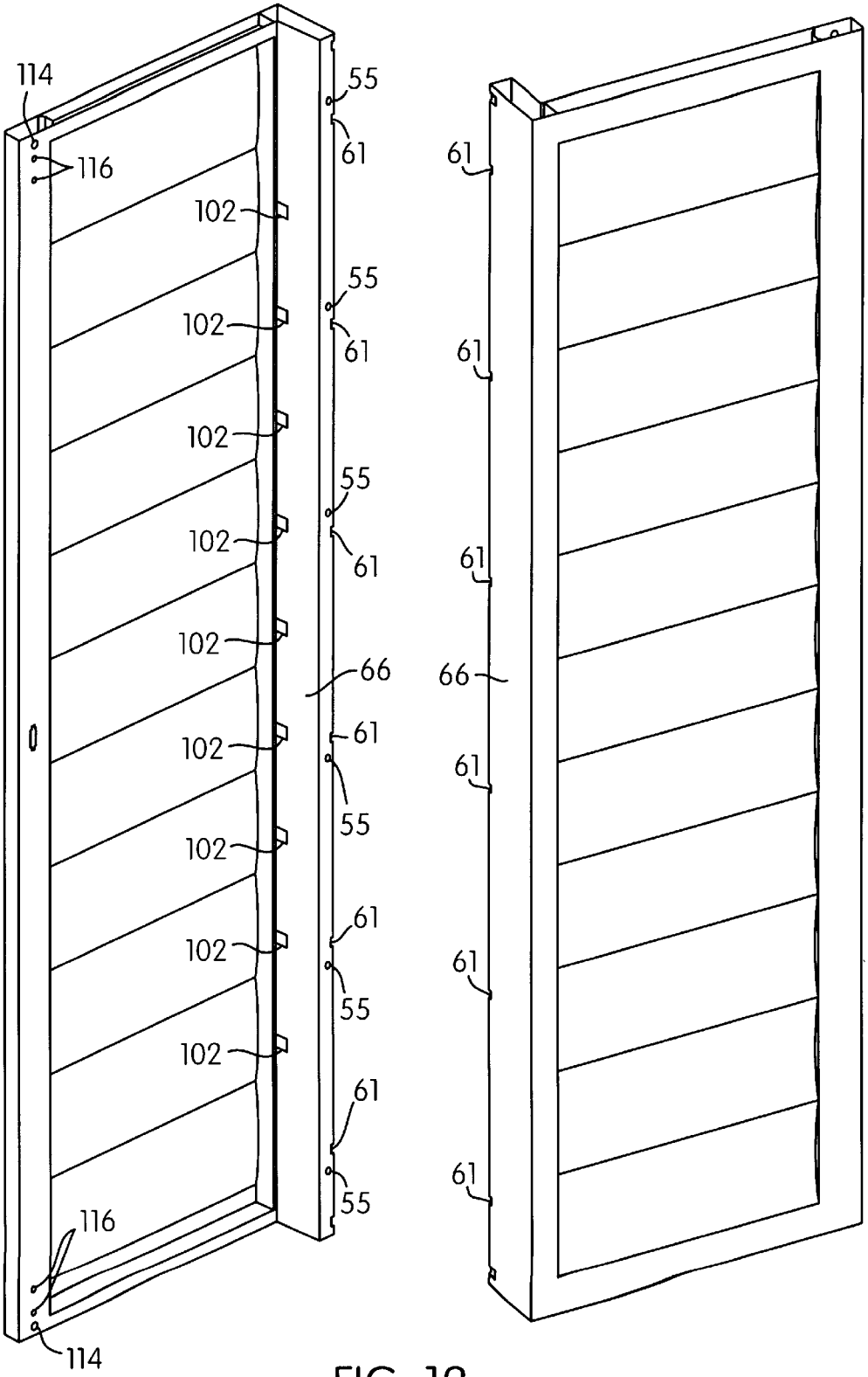
FIG. 12 is a perspective view of a side wall of the of the injected plastic cabinet according to the present invention (inner side—left outer side—right)
Figure 13:
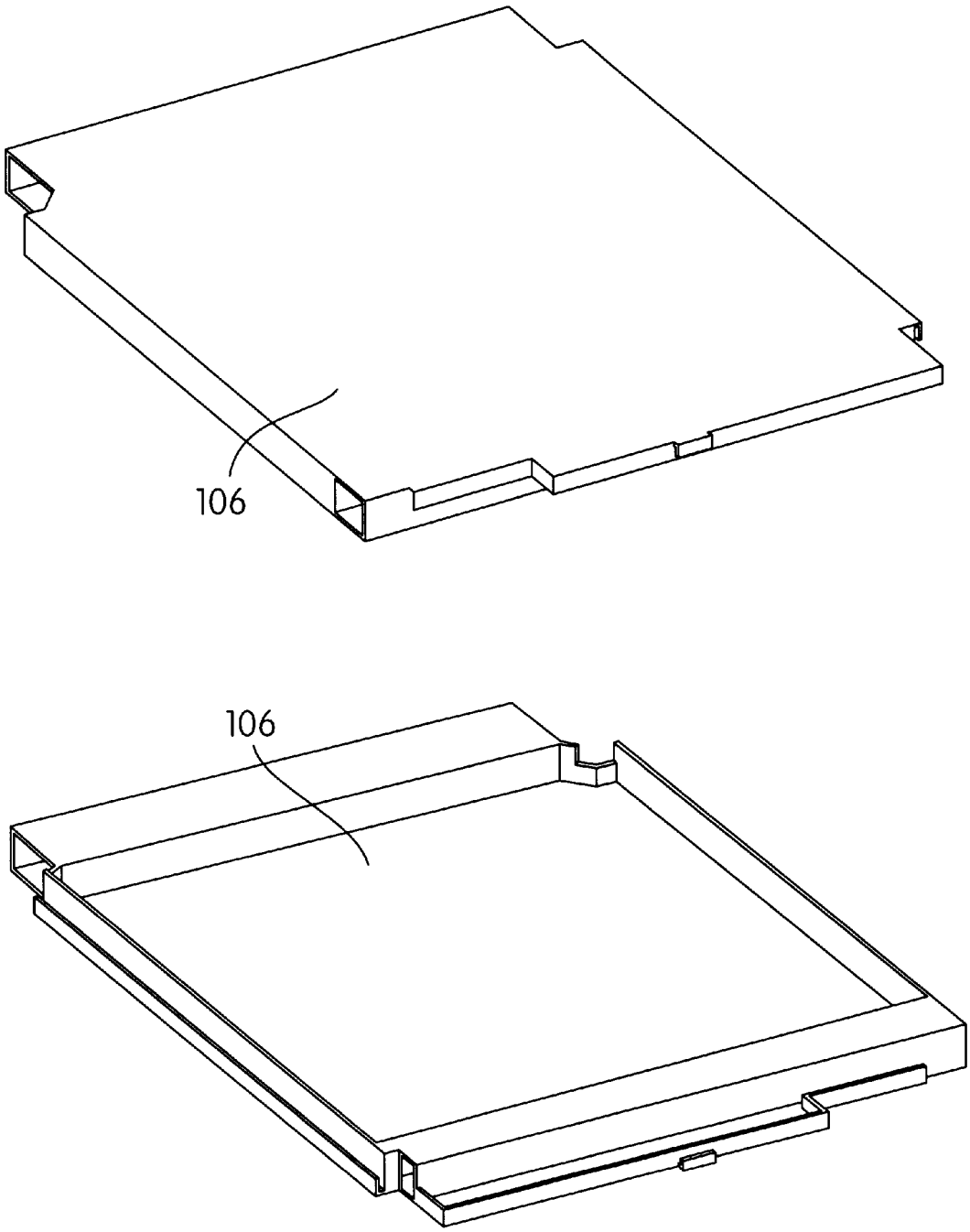
FIG. 13 is a perspective view of a partial shelf deployed in the injected plastic cabinet according to the present invention (upper side—up, lower side—down)
Figure 14:
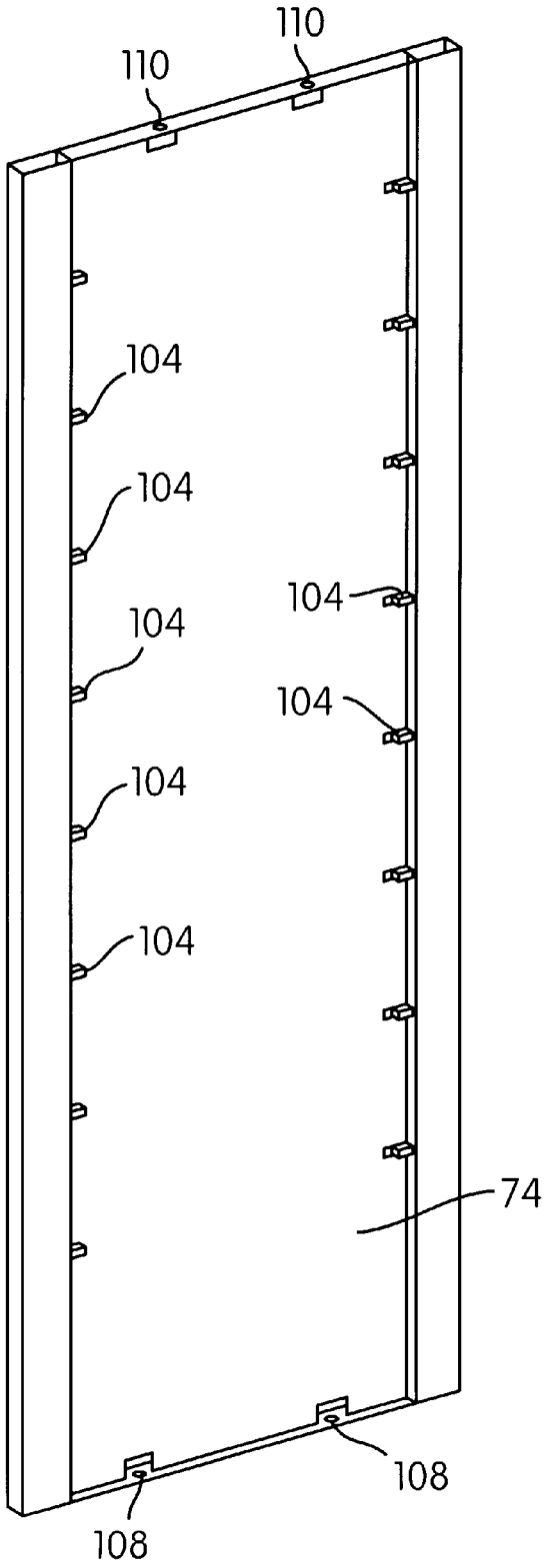
FIG. 14 is a perspective view of a divider deployed in the injected plastic cabinet according to the present invention.

FIGS. 11 and 12 show in more detail back wall 56 and a side wall 56/58. Back wall 56 and left 58 and right 60 side walls are connected therebetween via adjustment pins 55 and snap-on mechanisms 57 accepted by pin holes 59 and snap grooves 61, respectively.

Please note that in the example of FIGS. 11 and 12 elements 55 and 61 are formed on side walls 56/58, whereas elements 59 and 57 on back wall 56. However, this arrangement is not intended to be limiting, as other arrangements are within the scope and spirit of the present invention.

As specifically shown in FIG. 12, side walls 56/58 are preferably L shaped, such that they also contribute to the back side of cabinet 50.

Injected plastic cabinet 50 further includes at least one door element 66 (two are shown, 66*a* and 66*b*) being hingedly connected to at least one of left 58 and/or right 60 side walls, for covering front opening 64.

According to a preferred embodiment of the present invention back wall 56, left 58 and right 60 side walls and door element(s) 66, are each at least 140 centimeters in height, preferably at least 150 centimeters in height, more preferably, at least 160 centimeters in height, most preferably, at least 170 centimeters in height, ideally at least 180 centimeters in height, and are each a product of a single plastic injection, i.e., each is injected using a single injection mold.

It will be appreciated that equivalent components in the second generation plastic cabinets described in the Background section above, each includes two injected parts each of a maximal height of about 90 centimeters, which are connected together to form the back, side walls and doors.

Figure 3:
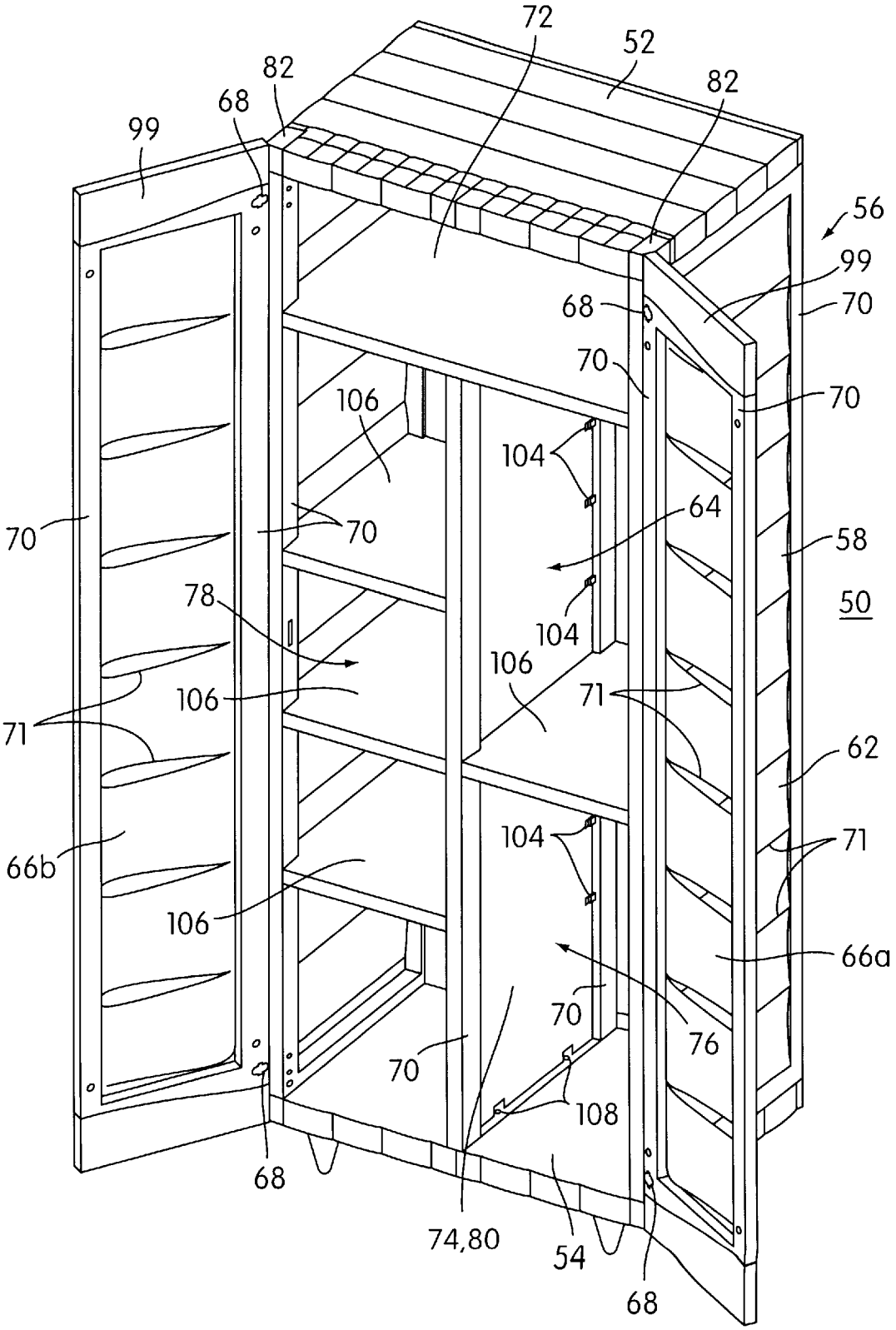
FIG. 3 is a perspective front view of the injected plastic cabinet according to resent invention, having its two doors open.
Figure 4:
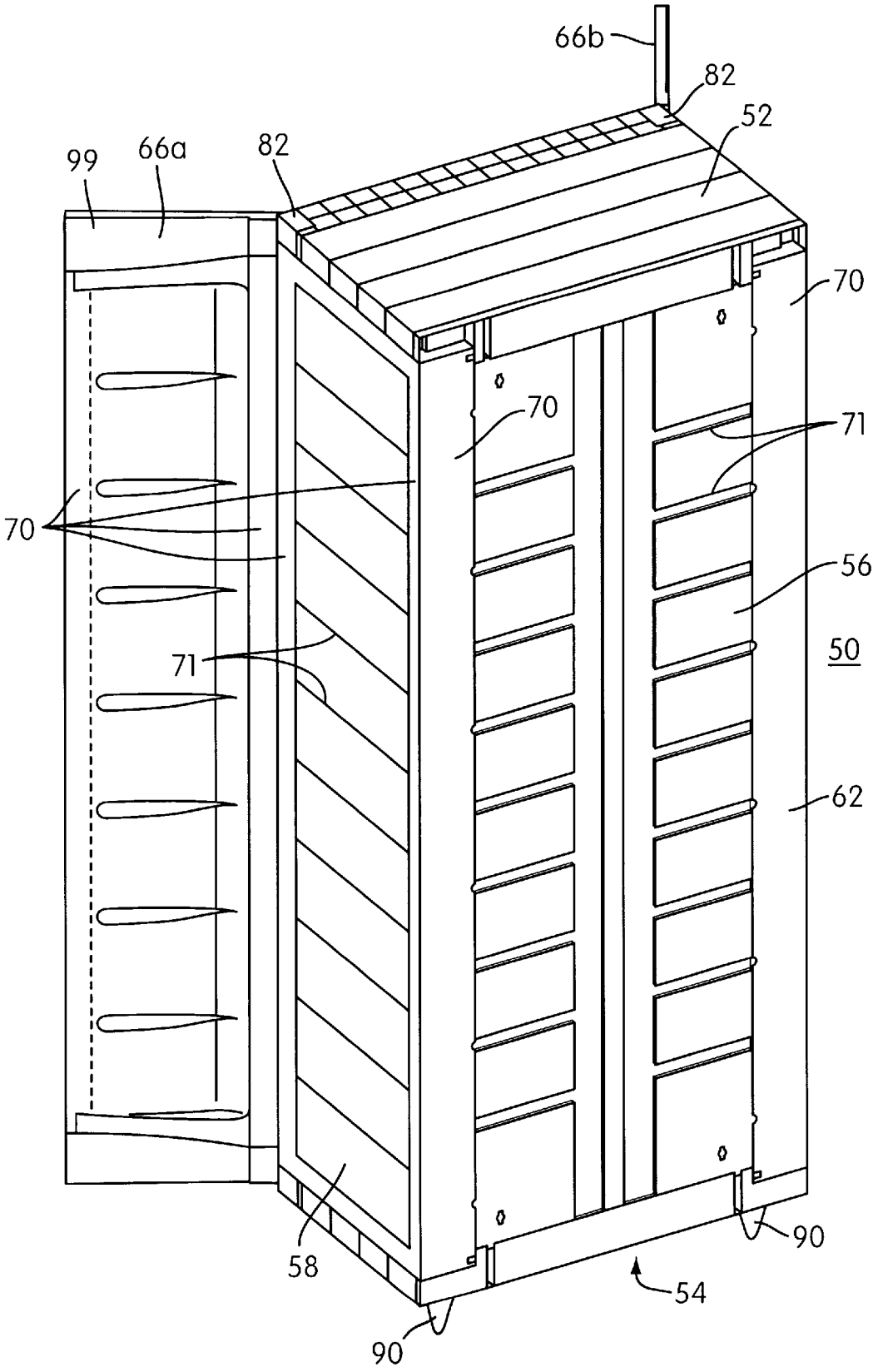
FIG. 4 is a perspective rear view of the injected plastic cabinet according to the present invention, having its two doors open.

According to another preferred embodiment of the present invention, door element(s) 66 are hingedly connected to left 58 and/or right 60 side walls via metal hinges 68, best seen in FIG. 3.

In the two doors configuration of cabinet 50, left door element 66*a* is hingedly connected to left side wall 58, whereas right door element 66*b* is hingedly connected to right side wall 60.

Metal hinges 68 are, for example, regular hinges for cabinet doors which are conventionally employed with wood-made cabinets. Suitable hinges are distributed by FERRARI (AGOSTINO FERRARI S.p.A., 22053 Lecco, Italy) and include a door part, a side wall part and a hinge part connecting therebetween.

According to yet another preferred embodiment of the present invention back wall 56, left 58 and right 60 side walls and door element(s) 66 are each formed with longitudinal strengthening internal cells 70, typically deployed along their longitudinal edges (optionally also along their longitudinal center line). Traversing strengthening ribs 71 are preferably also employed, as well known in the art.

The advantages of internal strengthening cells are well known. Such a cell, having a rectangular or triangular cross section is acquired strength just as much as a rod having identical shape and dimensions, however, since the cell weights much less than its equivalent rod and does not have to carry its own weight, it becomes effectively stronger.

Figure 6:
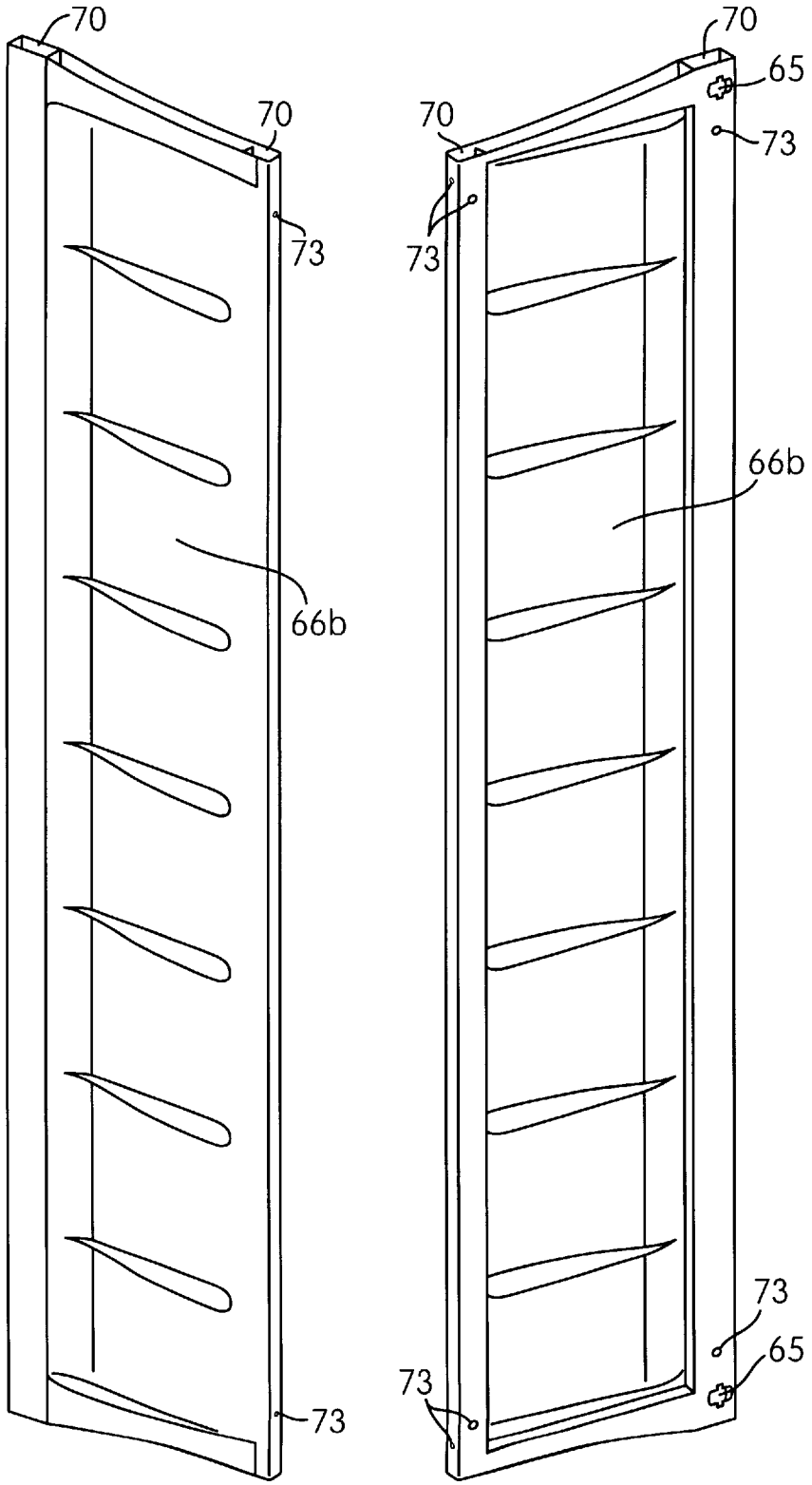
FIG. 6 is a perspective view of a right door element of the injected plastic cabinet according to the present invention (inner side—right, outer side left)
Figure 7:
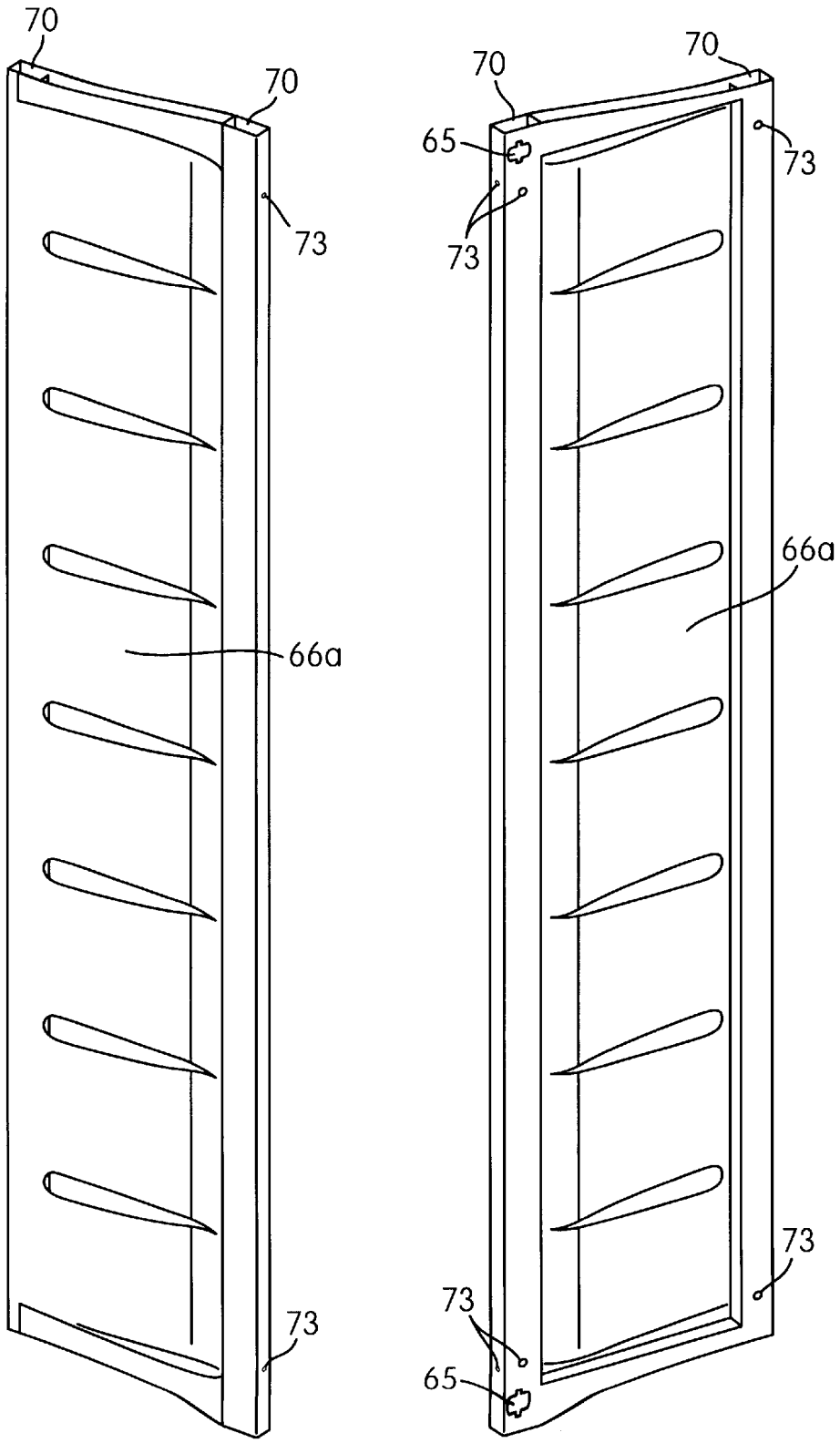
FIG. 7 is a perspective view of a left door element of the injected plastic cabinet according to the present invention (inner side—right, outer side left)
Figure 8:
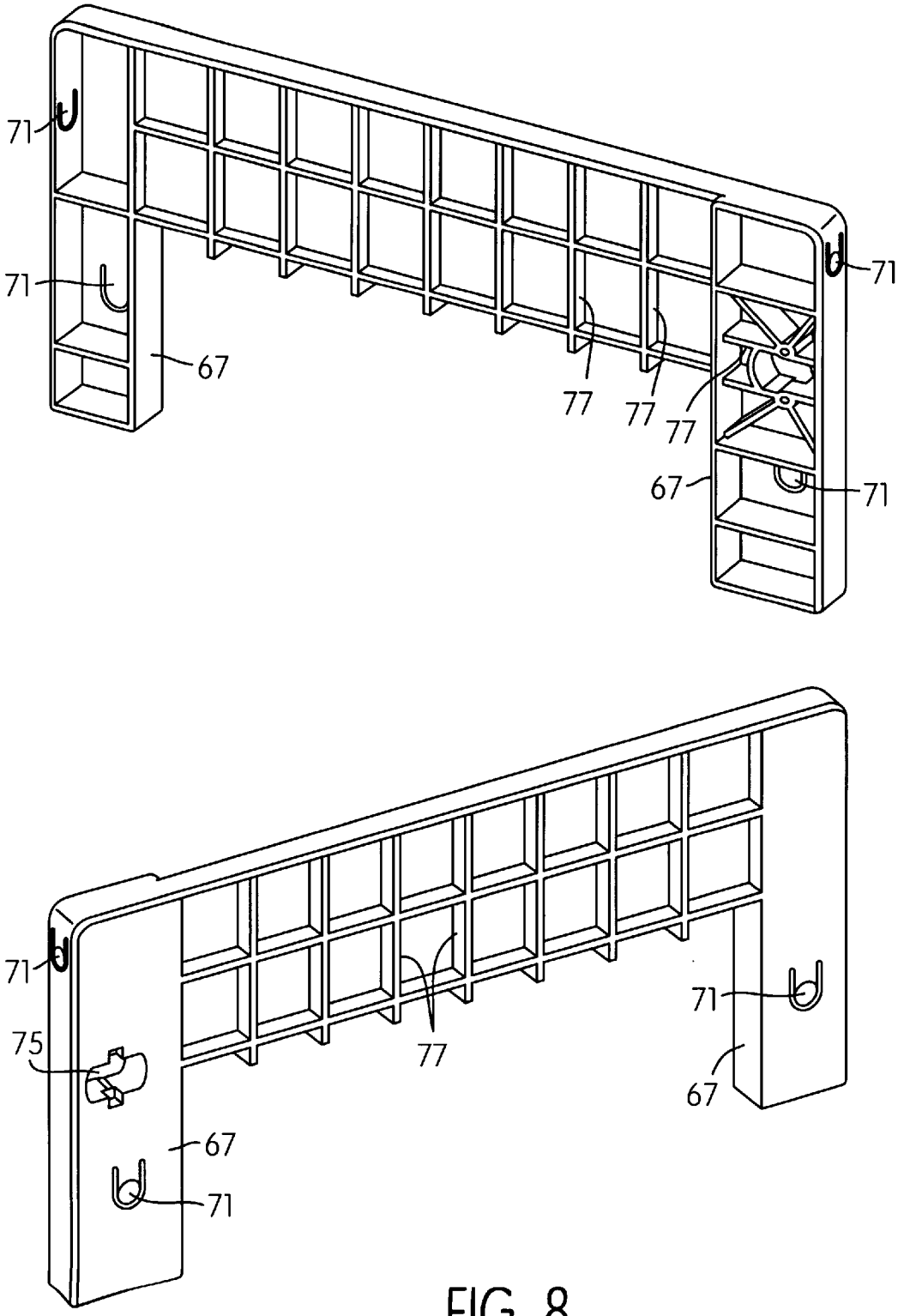
FIG. 8 is a perspective view of upper and lower door elements of the injected plastic cabinet according to the present invention (frontal view—down, rear view up)
Figure 9A:
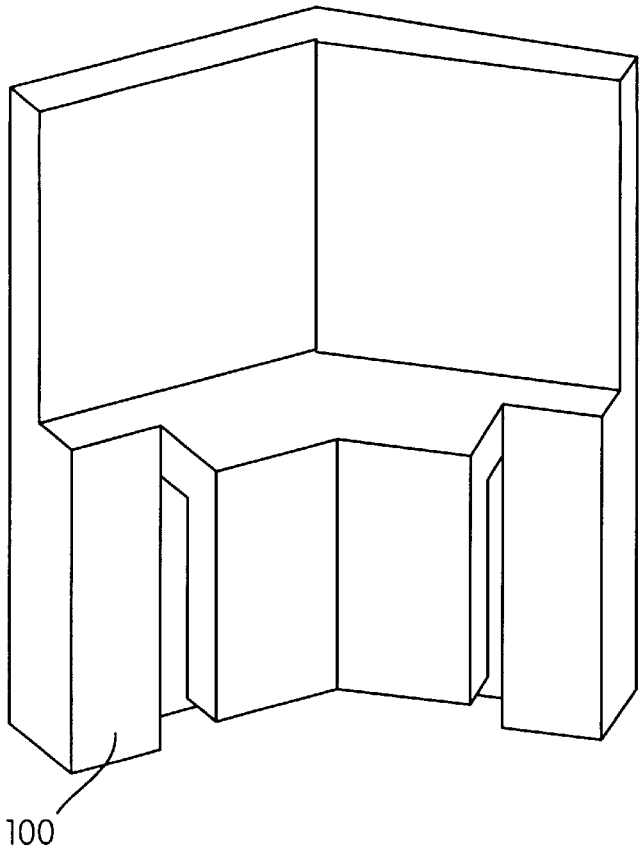
FIGS. 9*a–b* are perspective views of two shelf holders of the injected plastic cabinet according to the present invention.
Figure 9B:
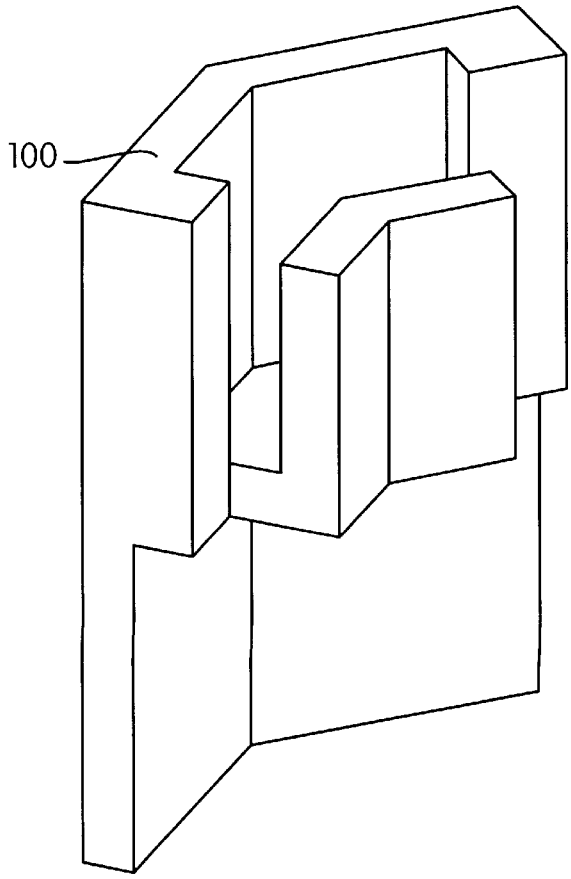
Figure 10:
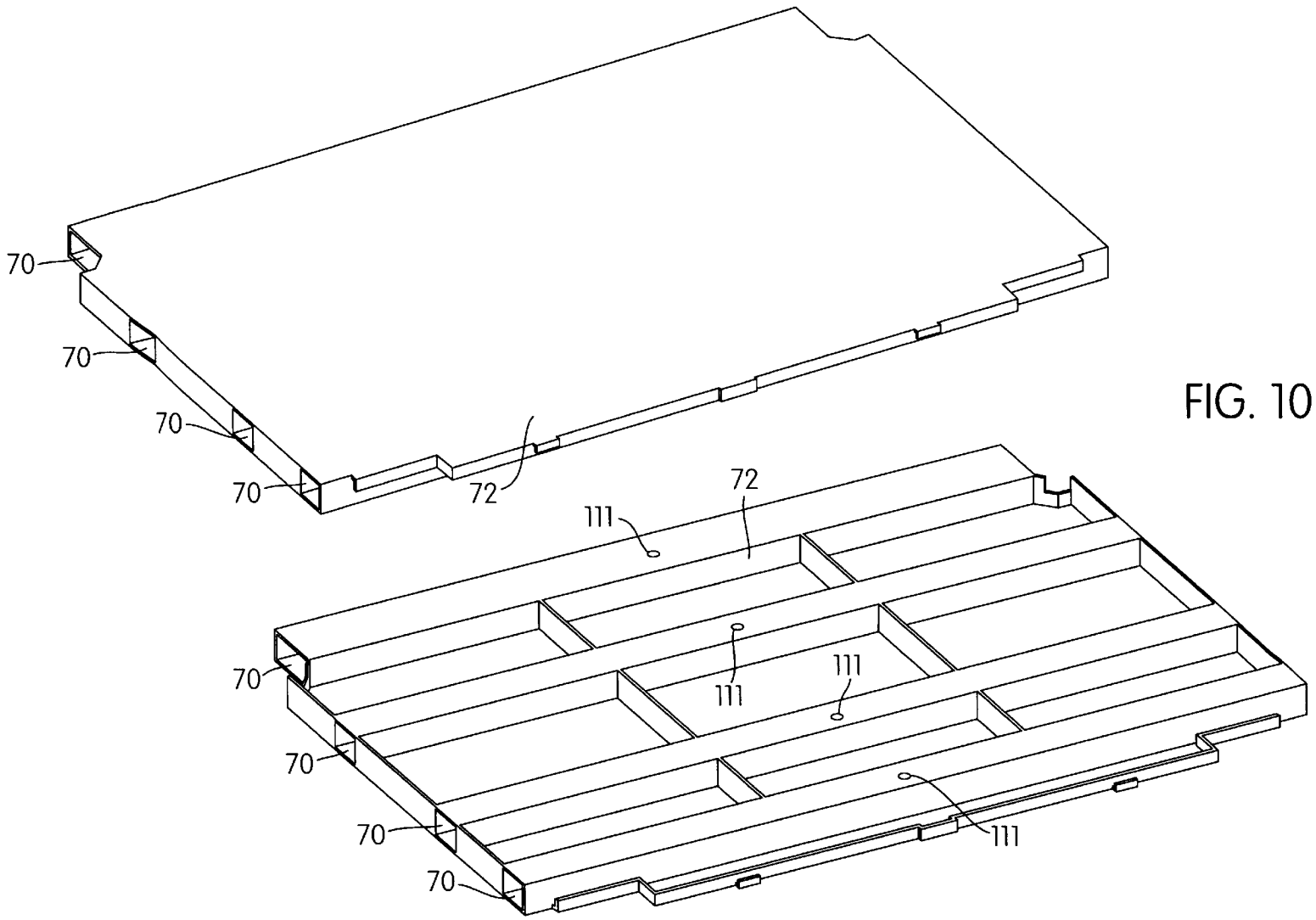
FIG. 10 is a perspective view of a shelf deployed in the injected plastic cabinet according to the present invention (upper side—up, lower side—down)

As shown in FIGS. 6–8, door elements 66 are formed with openings 65 shaped and sized for accepting the door parts of metal hinges 68. Equivalent openings for accepting the side wall parts of hinges 68 are formed in side walls 58 and/or 60. Upper and lower door elements 69 are provided, featuring legs 67 adapted to be insertable into cells 70 of door elements 66. Legs 67 are provided with a snap-on mechanism 71 adapted to snap onto holes 73 formed in door elements 66. Elements 69 are formed with housings 75 designed to tightly accept and support the door parts of metal hinges 68. Elements 69 are preferably provided with strengthening ribs 77.

Upper door elements 69 further serve for holding upper door covers 99, which serve for decoration. Covers 99, if so designed, may also serve to cover the gap typically present between door elements 66 and box 62, such that rain water is prevented from entering cabinet 50.

According to yet another preferred embodiment of the present invention injected plastic cabinet 50 further includes at least one shelf 72. Shelf 72 is connected to internal strengthening cells 70 of side walls 58 and 60, thereby contributes strength and stability to cabinet 50.

It will be appreciated that in the second generation plastic cabinets described in the Background section above, shelves are connected via hooks to regions between cells, thereby not contributing strength and stability, on the contrary, strength and/or stability might be reduced due to their weight.

According to yet another preferred embodiment of the present invention injected plastic cabinet 50 further includes a longitudinal divider 74, best seen in FIG. 3. Divider 74 serves for dividing box 62 into left 76 and right 78 sections. According to one embodiment, divider 74 is a complete divider which completely divides box 62 into left 76 and right 78 sections, whereas according to another embodiment, as specifically shown in FIGS. 3 and 5, divider 74 is a partial divider 80, which divides only a part, say the lower part (e.g., about 5/6, 4/5, or 3/4, etc.), of box 62 into left 76 and right 78 sections. Divider 74 is preferably also formed with strengthening internal cells 70, and is engaged to the inner sides of bottom 54 and back wall 56 via suitable connectors.

FIGS. 9–13 describe in more detail the structure and function of shelf 72, divider 74 and additional preferred features of cabinet 50. Thus, shelf 72 is preferably also formed with internal strengthening cells 70. Shelf holders 100, engagable by supports 102 protruding from the inner side of side walls 56/58, serve to firmly connect shelf 72 to cabinet 50, such that it becomes a part strengthening, supporting and stabilizing the construction of cabinet 50. The constructions of the corners of shelf 72 are selected to match that of holders 100, such that holders 100 firmly engage shelf 72. Divider 74 is provided with similar supports 104 for engaging partial shelves 106. Divider 74 is further supplemented with a connection mechanism 108 connecting it, via accepting holes 107 (FIG. 15) to bottom 54. In its upper part divider 74 includes a connection mechanism 110 connecting it to top 52 or shelf 72 via accepting holes 111, depending weather it is a complete or partial divider.

According to a further preferred embodiment of the present invention injected plastic cabinet 50 further includes at least two adapters 82. Adapters 82 are inserted through openings 84 formed in top 52 into longitudinal strengthening internal cells 70 of left 58 and right 60 side walls, thereby contributing strength and stability to cabinet 50.

According to still further preferred embodiment of the present invention injected plastic cabinet 50 further includes at least two additional adapters 86. Adapters 86 are inserted through openings 88 formed in bottom 54 into longitudinal strengthening internal cells 70 of left 58 and right 60 side walls, thereby contributing strength and stability to cabinet 50.

Figure 15:
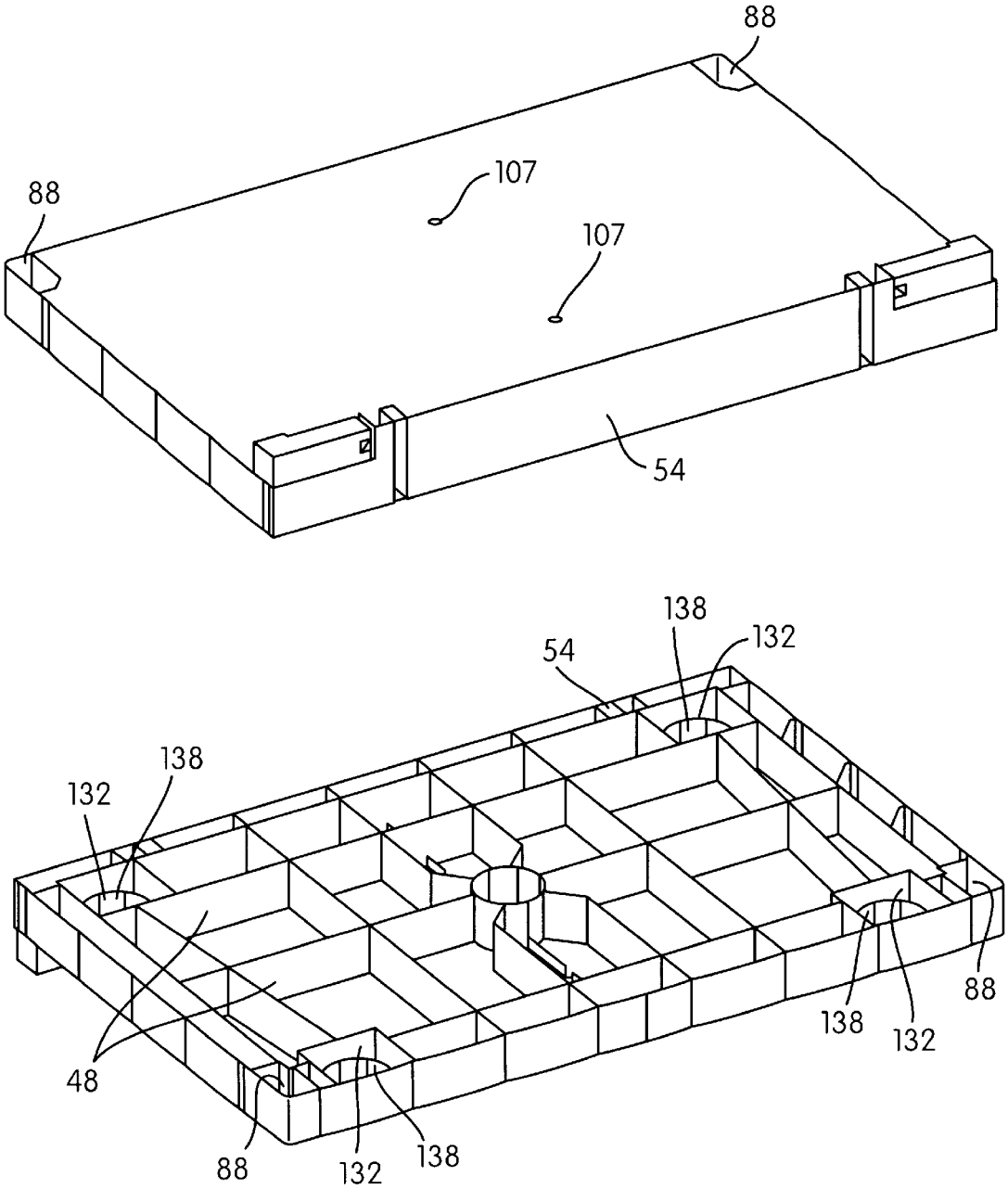
FIG. 15 is a perspective view of a bottom deployed in the injected plastic cabinet according to the present invention (upper side—up, lower side—down)
Figure 16:
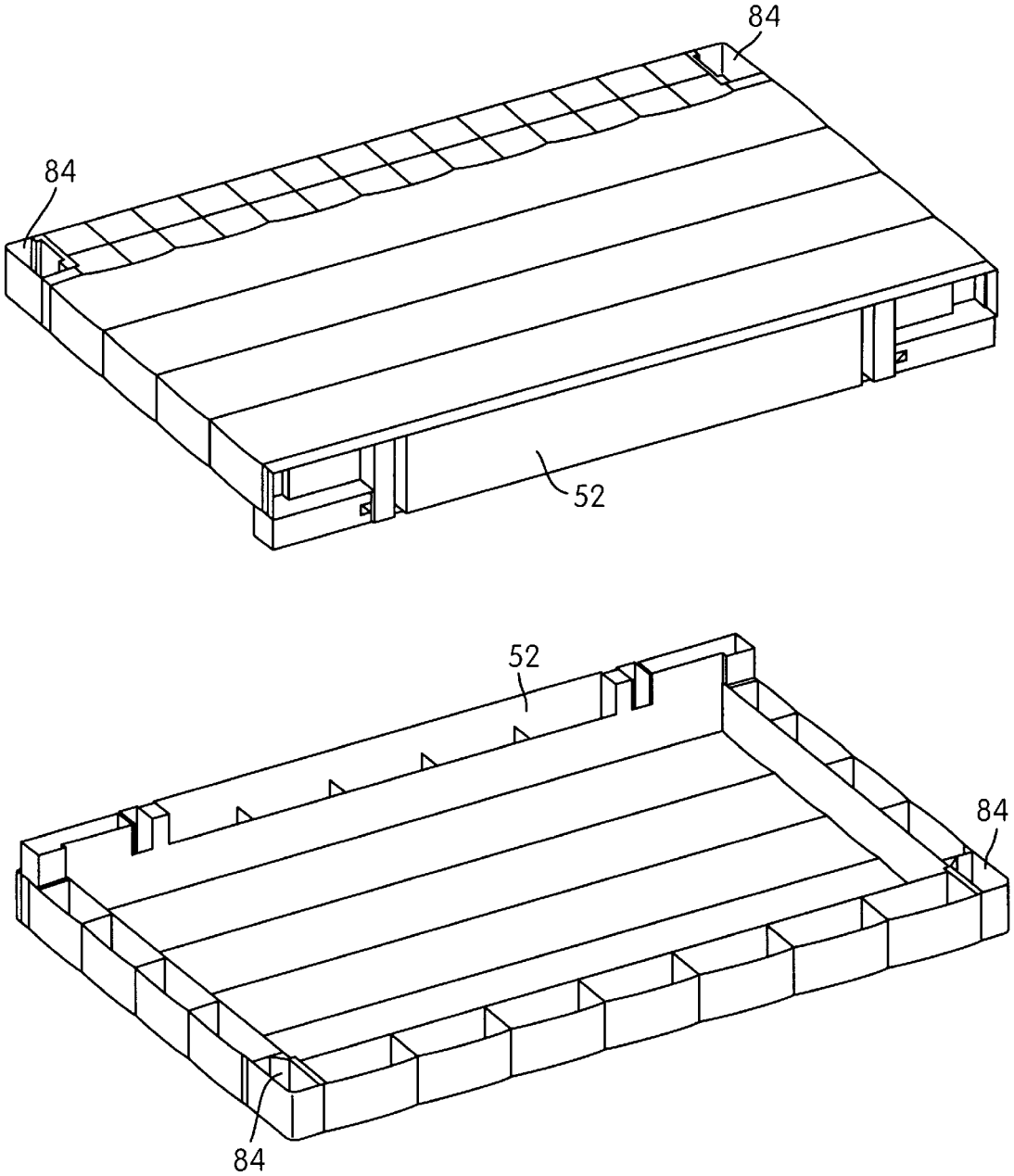
FIG. 16 is a perspective view of a top deployed in the injected plastic cabinet according to the present invention (upper side—up, lower side—down)
Figure 17:
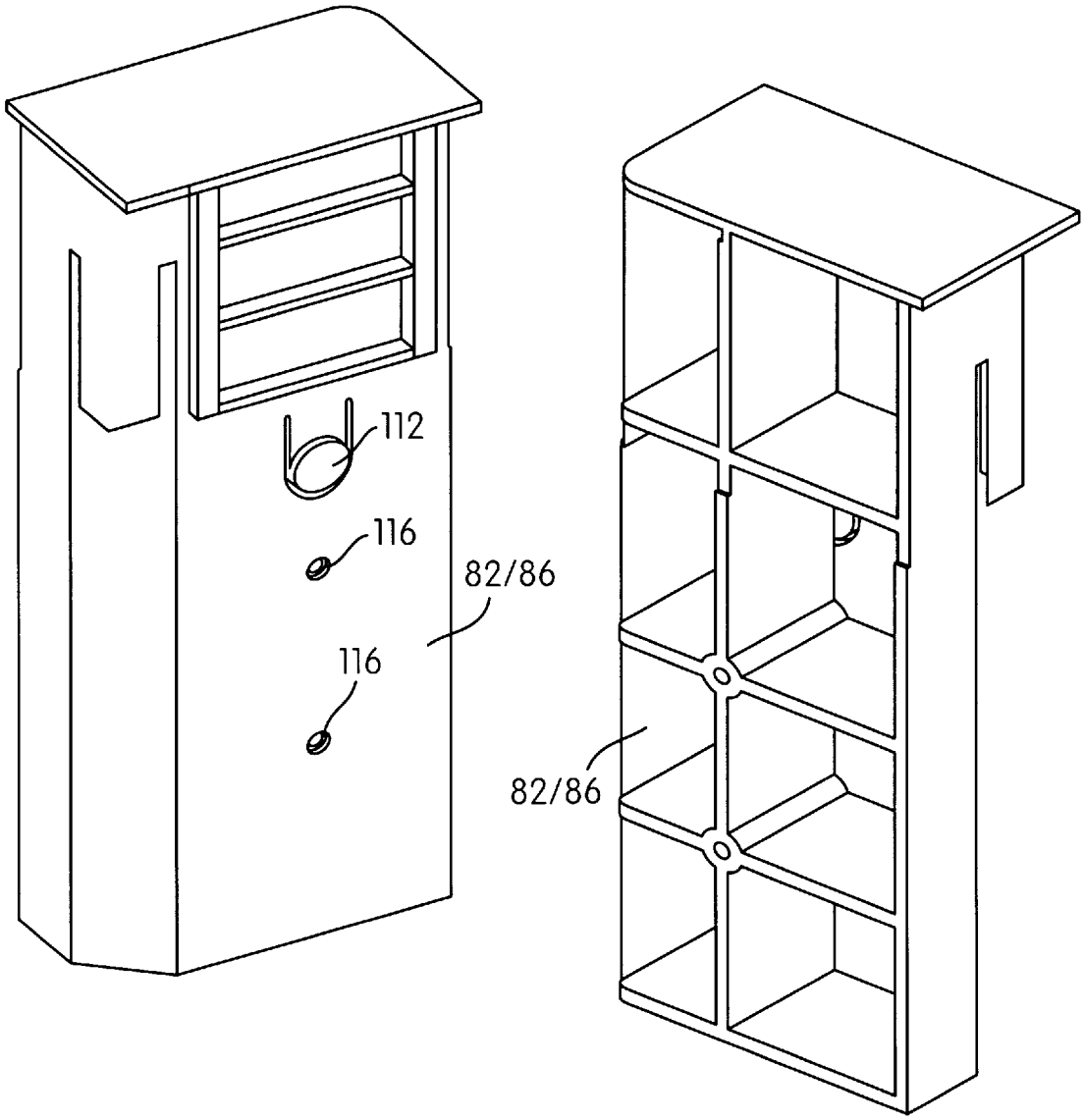
FIG. 17 is a perspective view of an adapter deployed in the injected plastic cabinet according to the present invention (frontal side—left, rear side—right)

FIGS. 15–17 show top 52, bottom 54 and adapters 82/86 in greater detail. Thus, adapters 82/86 are sized to fit into and protrude from openings 84/88 formed in top 52/bottom 54 into longitudinal strengthening internal cells 70 of left 58 and right 60 side walls. A snap-on mechanism 112 and accepting holes 114 (FIG. 11) serve to connect top 52/bottom 54 to side walls 58/60. Additional holes 116 formed both in side walls 58/60 and in adapters 82/86 serve to screw the elements together via a screw. Holes 116 are therefore preferably threaded. Bottom 54 is preferably formed with strengthening ribs 118.

According to still further preferred embodiment of the present invention injected plastic cabinet 50 further includes leveling legs 90. Legs 90 are accepted by bottom 54. Legs 90 may be pointed or cylindrical.

Figure 18:
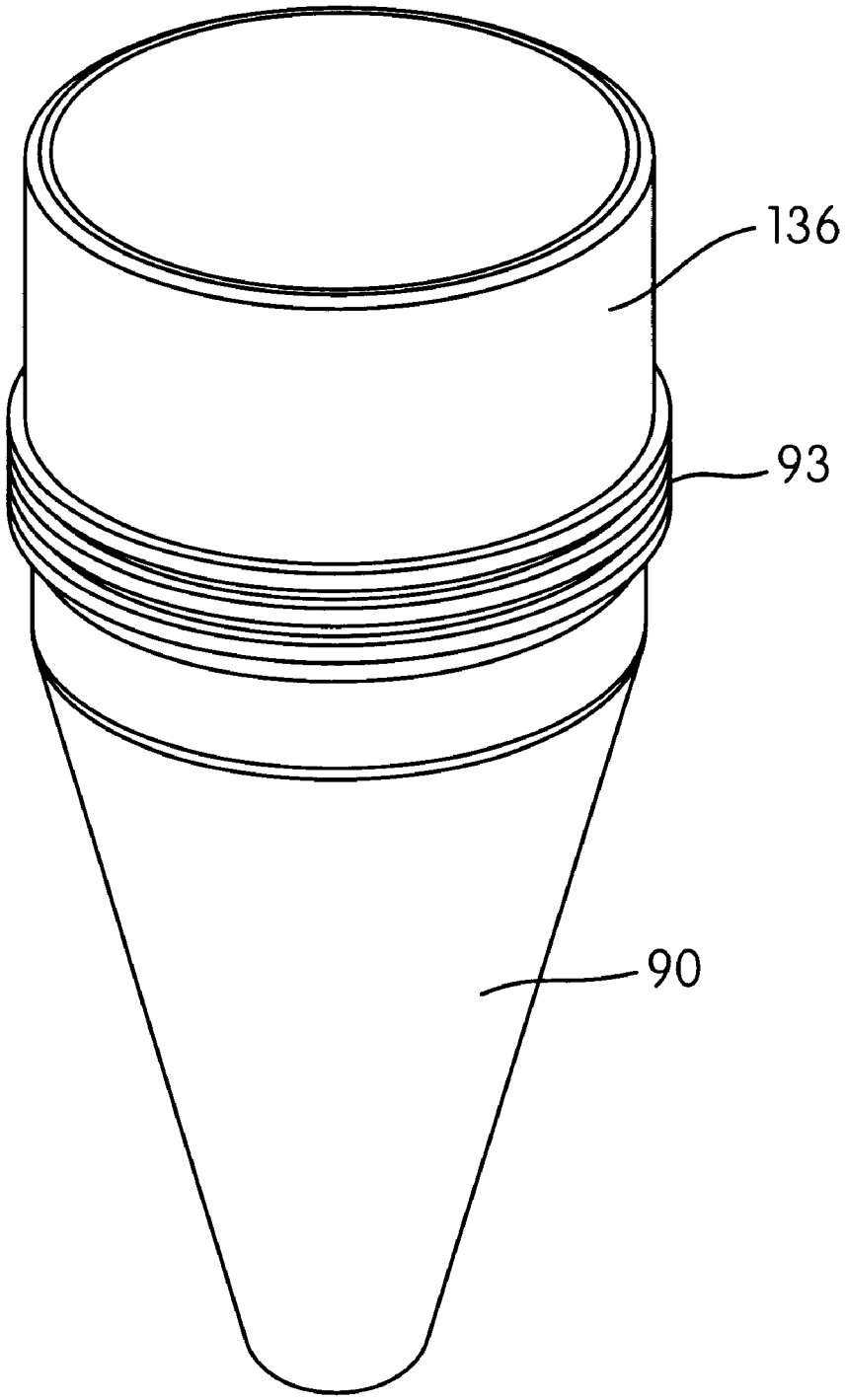
FIG. 18 is a perspective view of a leveling leg deployed in the injected plastic cabinet according to the present invention.
Figure 19:
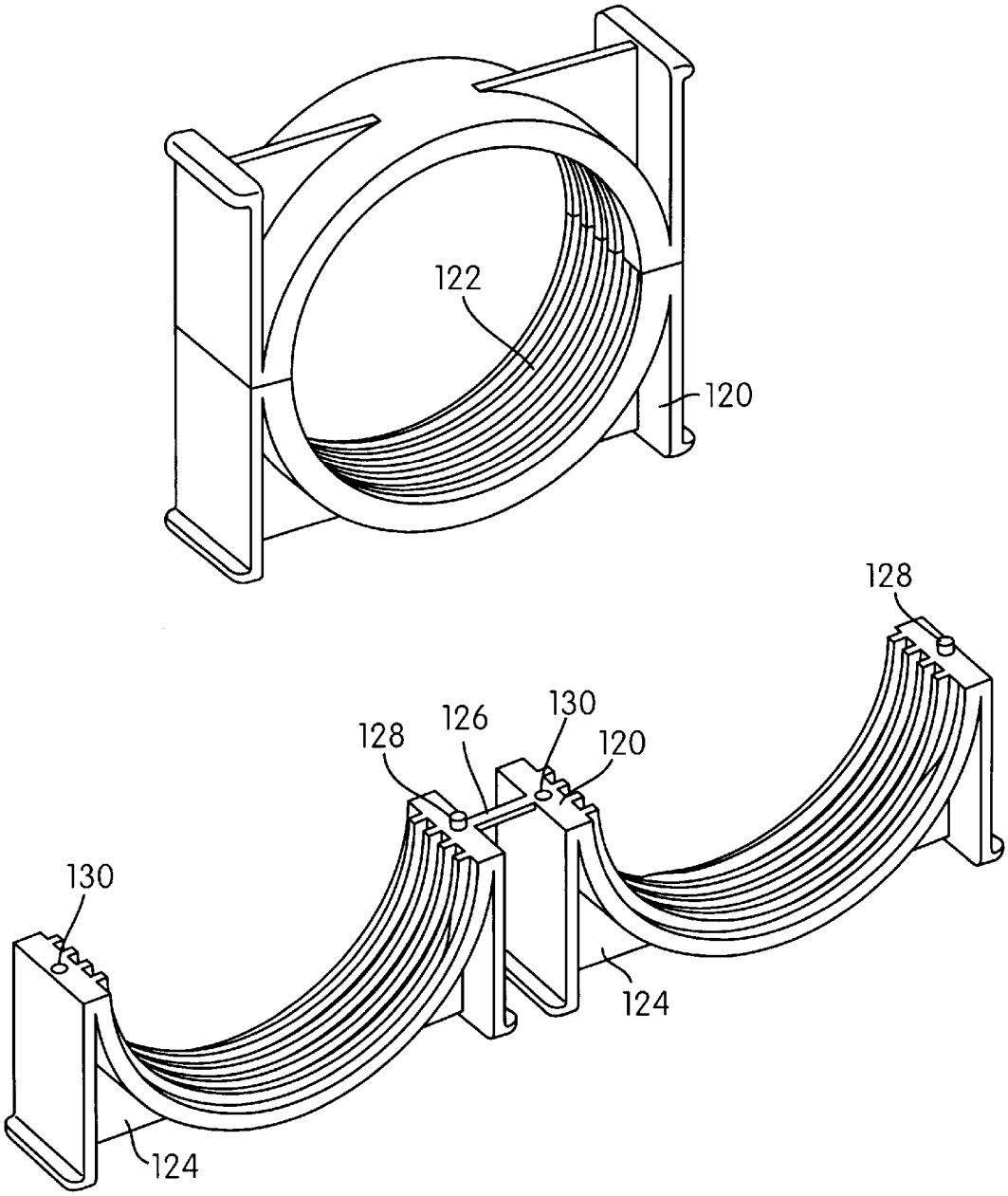
FIG. 19 is a perspective view of a leveling leg housing deployed in the injected plastic cabinet according to the present invention (assembled—up, disassembled -down).

FIGS. 18 and 19 show the construction and functionality of leveling legs 90 in greater detail. Thus, a threaded housing 120 is provided. Housing 120 is formed having rectangular external features and a threaded hole 122. Housing 120 is preferably manufactured having two sections 124 connected therebetween with an integral hinge 126. Sections 124 are integrated or assembled into a functional housing 120 by folding hinge 126 and snapping together sections 124. Snapping is effected via matching pins 128 and holes 130 formed in housing 120. Hosing 120 serves to accept leg 90. To this end, leg 90 is formed having a threaded section 93. A plurality of housings 120, say four or five, are insertable into dedicated acceptors 132 formed in the external side of bottom 54 (shown in FIG. 15), whereas legs 90 are screwably accepted by housings 120. Leveling is effected by differential screwing of individual legs 90. According to a preferred embodiment, legs 90 are supplemented with an extended top part 136 which reaches dedicated supporters 138 formed in bottom 54, which provides legs 90 with extra stability.

According to a preferred embodiment of the present invention all of the components of cabinet 50 are injected plastic components.

The injected plastic cabinet according to the present invention is highly advantageous as compared with the prior art plastic cabinets because it includes less parts, it is easy to assemble, and due to its special design and features, it enjoys extra stability, strength and balance.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. An injected plastic cabinet comprising a top being formed with two openings, a bottom, a back wall, and left and right side walls being connected together, forming a box having a front opening, and at least one door element being hingedly connected to at least one of said left and right side walls via metal hinges for covering said front opening, wherein each of said back wall, left and right side walls and said at least one door element is a product of a single plastic injection, each of said back wall, left and right side walls and said at least one door element being formed with longitudinal strengthening internal cells, the injected plastic cabinet further comprising at least two adapters being inserted through said two openings of said top into said longitudinal strengthening internal cells of said left and right side walls, thereby contributing strength and stability to the cabinet, at least one of said metal hinges being connected via a screw to at least one of said adapters, thereby locking together said top, said at least one of said adapters and at least one of said left and right side walls.

2. The injected plastic cabinet of claim 1, wherein each of said back wall, left and right side walls and said at least one door element is at least 160 centimeters in height.

3. The injected plastic cabinet of claim 1, further comprising at least one shelf being connected to said internal cells of said side walls, thereby contributing strength and stability to the cabinet.

4. The injected plastic cabinet of claim 1, further comprising leveling legs being accepted by said bottom.

5. The injected plastic cabinet of claim 4, wherein the number of leveling legs is selected from the group consisting of four and five.

6. The injected plastic cabinet of claim 1, wherein said back wall and said left and right side walls are connected therebetween via adjustment pins and snap-on mechanisms.

7. The injected plastic cabinet of claim 1, further comprising a longitudinal divider dividing said box into left and right sections.

8. The injected plastic cabinet of claim 1, wherein said at least one door element includes a left door element hingedly connected to said left side wall and a right door element hingedly connected to said right side wall.

* * * * *